United States Patent [19]

Tress et al.

[11] 4,013,283

[45] Mar. 22, 1977

[54] PULL-FOOT SHEET FEEDING DEVICE

[75] Inventors: Norwood E. Tress, Bath; Winston A. Orsinger, Bethlehem, both of Pa.

[73] Assignee: Bell & Howell Company, Phillipsburg, N.J.

[22] Filed: Aug. 29, 1975

[21] Appl. No.: 608,970

[52] U.S. Cl. ..... 271/14; 271/100; 271/106; 271/115; 271/171; 271/263

[51] Int. Cl.[2] ..... B65H 3/08; B65H 3/50

[58] Field of Search ..... 271/100, 101, 102, 99, 271/106, 14, 11, 20, 115, 263, 262, 171

[56] References Cited

UNITED STATES PATENTS

| | | | |
|---|---|---|---|
| 1,039,541 | 9/1912 | Kast | 271/262 X |
| 2,748,971 | 6/1956 | Flynn | 271/100 X |
| 3,741,535 | 6/1973 | Palkovic et al. | 271/101 |

*Primary Examiner*—Evon C. Blunk
*Assistant Examiner*—Bruce H. Stoner, Jr.
*Attorney, Agent, or Firm*—Griffin, Branigan and Butler

[57] ABSTRACT

In a mechanism for feeding individual sheets of paper separately from a stack of paper sheets, a separating device exposes an edge of an outer sheet and a "pull-foot" is oscillated between the separated sheet and a remaining stack. A roller is concurrently moved into position to pinch the separated sheet between the pull-foot and the roller. The pull-foot is oscillated away from the stack and, in doing so, the outer sheet is pulled from the stack by interaction between the pull-foot and the roller.

16 Claims, 4 Drawing Figures

PULL-FOOT SHEET FEEDING DEVICE

BACKGROUND OF THE INVENTION

The invention relates to sheet feeding apparatus for separating single sheets from a stack of sheets.

In many prior-art sheet feeding apparatus, high-mass gripper jaw assemblies commonly have been utilized to grasp sheets and pull them from stacks. However, these gripper-jaw assemblies have often tended to experience vibrational and other problems at higher feeding speeds.

It is thus an object of this invention to provide a sheet feeding device which is equipped to efficiently accomplish the removal of individual sheets from a remaining stack at high speeds while having reduced vibrational and other problems. Another object of this invention is to provide an efficient high speed sheet feeding device which also senses "doubles" and "misses".

SUMMARY

In accordance with an aspect of this invention, a sheet feeding device includes a "pull-foot" which is oscillated to a position between a sheet to be separated and a remaining stack, and a bottom roller is concurrently moved toward the pull-foot so that the sheet is pinched between the pull-foot and roller. The pull-foot is then driven away from the stack and it pulls the pinched insert away with it.

BRIEF DESCRIPTION OF THE DRAWINGS

The foregoing and other objects, features, and advantages will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention in a clear manner.

DESCRIPTION OF A PREFERRED EMBODIMENT

Figure 1:
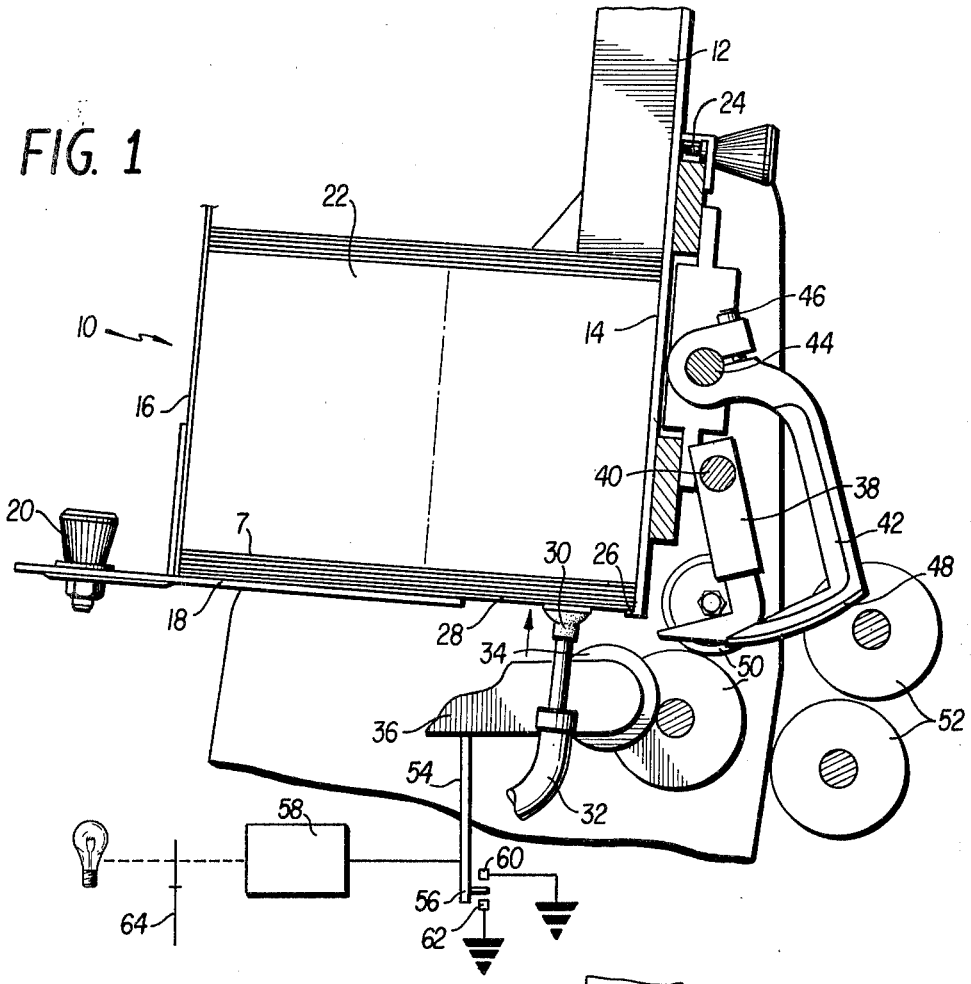
FIGS. 1 – 4 are simplified side, sectional views of a pull-foot sheet feeding device employing principles of this invention in various stages of its operational sequence the different figures having a few minor differences to aid in describing various embodiments.

Referring to the elements of the invention as embodied in the drawings, a main hopper assembly 10 comprises adjustable sidewalls 12, a vertical front plate 14, a vertical rear plate 16, and an adjustable hopper-bottom plate 18. The bottom plate 18 is secured to the rear plate 16 by an adjusting bolt 20, so that the size of the bottom-support needed can be varied by fore and aft manipulation of the bottom plate, depending on the size and flexibility of stacked sheets 22. The sidewalls 12 of the hopper assembly 10 are laterally adjustable by manipulating an adjustable bolt 24, in order to accommodate sheets of various sizes. The front plate 14 is equipped with slight protrusions 26 extending beneath a bottom-most sheet 28 of the stacked sheets 22 to lend additional support thereto.

Figure 2:
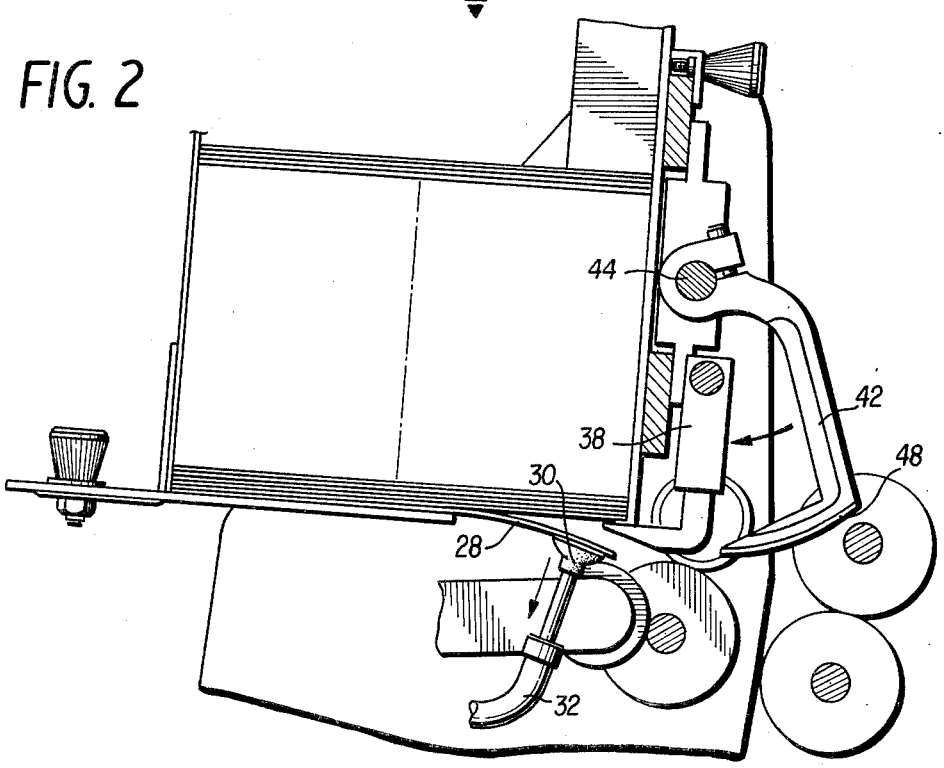
Figure 3:
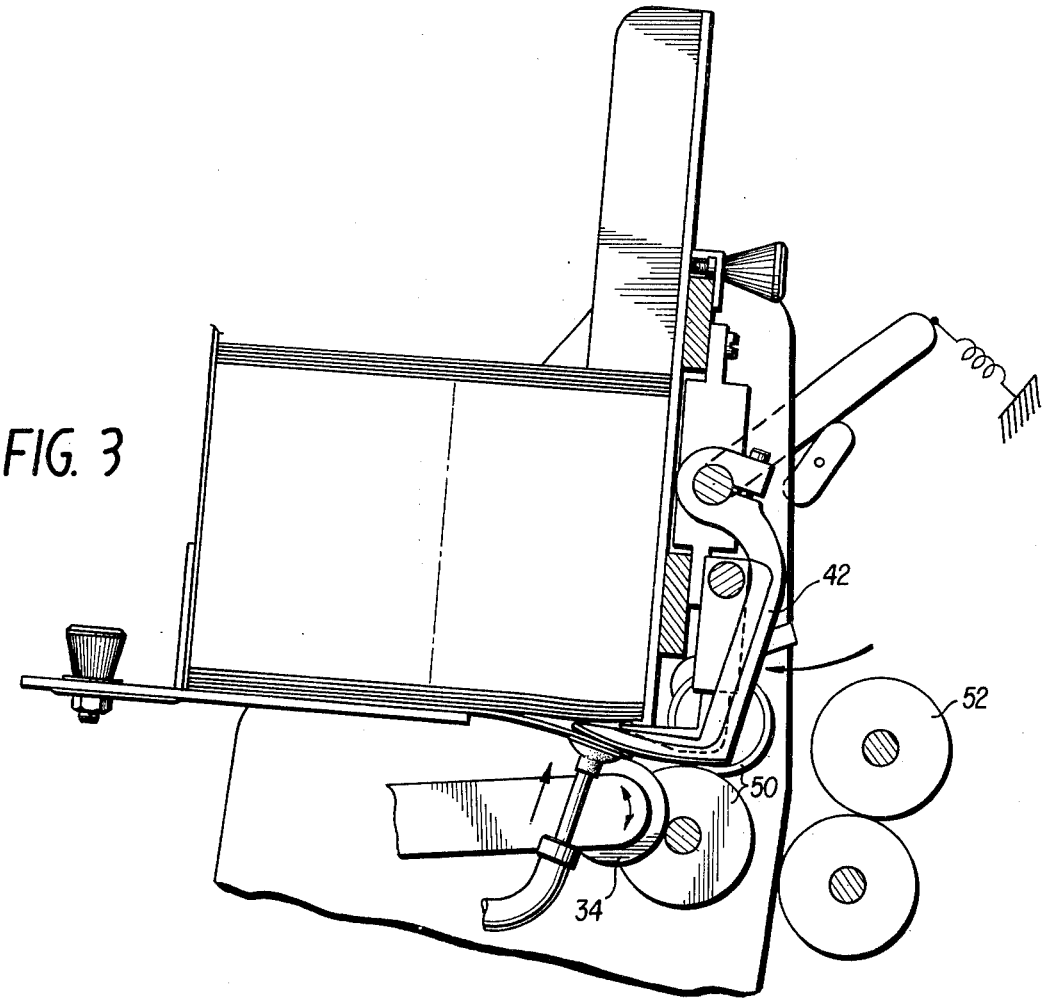

A suction cup 30 is connected to a suction line 32 and is operatively mounted for reciprocating movement toward and away from an exposed edge of the bottom-most sheet 28 of the stacked sheets 22. A bottom roller 34 is mounted on a pivotal arm 36 so that it can move toward and away from the bottom exposed edge of the bottom-most sheet 28. The bottom roller 34 is normally maintained in its lower position, FIGS. 1, 2 and 4, however, a cam mechanism (not shown) sequentially pivots the arm 36 and the bottom roller 34 to its raised position as shown in FIG. 3. The arm is resiliently mounted (mounting not shown) so that it can "give" downardly, but it is biased upwardly when the bottom roller 34 is in its raised position. The feeder is equipped with a separator foot 38 which is mounted for pivotal motion by a shaft 40 to assist in ensuring efficient separation. The separator foot 38 can be shifted from its position shown in FIG. 1 to that illustrated in FIG. 2 in which it serves to both support the remaining stack of sheets and maintain the bottom-most sheet 28 separate from the remaining stack.

A pull-foot 42 is mounted on a shaft 44 by a clamp screw 46. The pull-foot's shaft 44 is actuated by a camming device (not shown) so that, in sequence with upward movement of the bottom roller 34, the pull-foot's lower end is oscillated over the bottom-most sheet 28, as is illustrated in FIG. 3, and then outwardly to the FIG. 4 position. When the pull-foot 42 is moved inwardly, FIG. 3, and the bottom roller 34 is moved upwardly, the bottom surface of the pull-foot and the outer surface of the bottom roller 34 pinch and positively grip a sheet disposed between them. Generally speaking, in order to accomplish firm pinching contact, the bottom of the pull-foot is equipped with a high-friction tread 48 such as rubber or roughened metal.

Ejection rollers 50 and transfer roller 52 transport sheets away from the hopper assembly 10 once they have been separated by the pull-foot mechanism, as will be described in more detail below. In one embodiment, there are two side-by-side pull-feet and bottom rollers to act on each sheet, however, for the sake of clarity, only one of each of these members is described in detail herein.

In the sequence of the separating and feeding operation, the reciprocating suction cup 30 is brought into contact with the edge of the bottom-most sheet 28 of the stacked sheets 22 as shown in FIG. 1. Suction is applied through the line 32 and the suction cup 30 is then moved away (see FIG. 2), drawing the edge of the bottom-most sheet 28 with it. Then, the separator foot 38 is moved in on top of the bottom-most sheet 28 (as shown in FIG. 2) to ensure separation and to prevent the remaining sheets in the stack from being disturbed during the withdrawl. Up to this point, operation of the device is the same as in many prior-art devices.

Immediately thereafter, however, as is depicted in FIG. 3, the pull-foot 42 is cam oscillated over the bottommost sheet 28. Concurrently, the bottom roller 34 is cammed upwardly, so that the leading edge of the bent sheet 28 is pinched between the heel of the pull-foot 42 and the bottom roller 34. The high-friction tread 48 on the sole of the pull-foot 42 ensures a firm pinching contact.

When the pull-foot 42 is cammed into position, the vacuum in the line 32 is released, thus disengaging the suction cup 30 from the edge of the bottom-most sheet 28. The bottom roller 34 then cooperates with the pull-foot, and as the foot is driven outwardly, the bottom of the foot pulls the pinched sheet 28 away from the remaining stacked sheets 22. After being pulled away from the stacked sheets, the sheet 28 is grasped by the pair of cooperating ejection rollers 50, which, in turn, move the sheet to the high speed transfer rollers 52. In this respect, the ejection rollers 50 are one-way clutched. This is because the transfer rollers 52 are turning at a higher velocity than the ejection rollers 50, and the ejection rollers 50 must be permitted to slip in the direction of their driving rotation.

Figure 4:
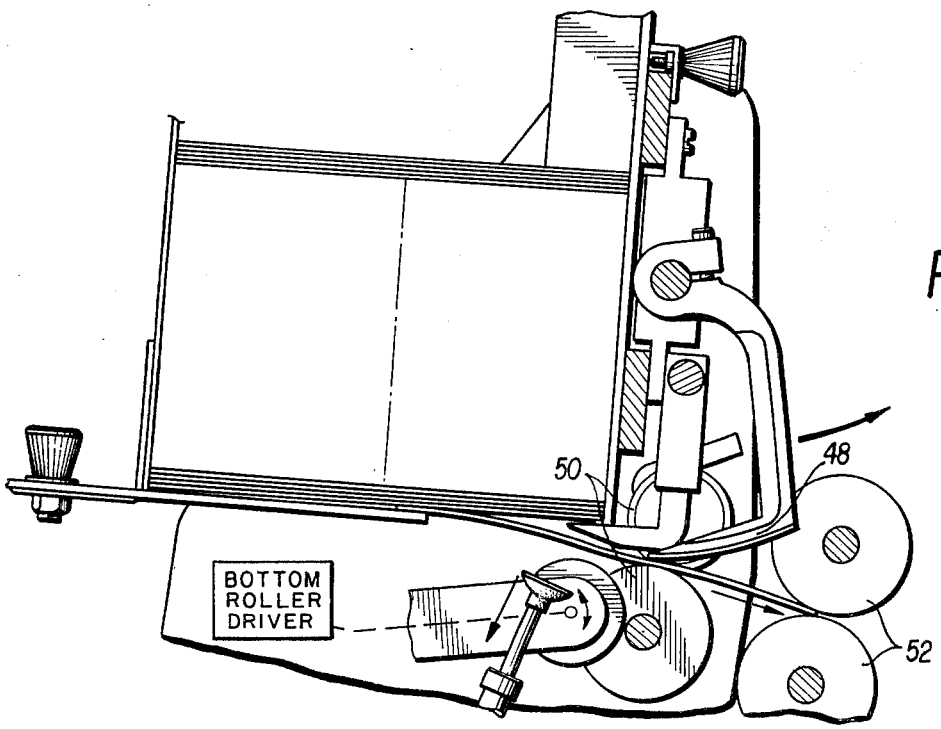

In one embodiment, the pull-foot does not supply the force which pulls sheets out of the stacked sheets 22, but rather this force is supplied by the bottom roller 34, which is driven as is shown in FIG. 4 for example. In this case, the pull-foot cam catches up to the pull foot at about the same time sheets are gripped by the ejection rollers 50 to rotate the pull-foot toward the stacked sheets 22. Thus, the pull-foot is only cammed inwardly, and is carried outwardly by the bottom roller 34. However, in another embodiment, the pull-foot 42 is driven outwardly by a separate driving force, such as a cam, and the bottom roller 34 is an idler roller as is depicted in FIG. 3 for example.

A detection system is also incorporated into the feeding device to sense any chance "miss" or "double". This system is similar to the mistake detector shown in U.S. Pat. No. 3,744,787, issued to Wilbur J. Morrison. The detector is illustrated schematically in FIG. 1 only. In this regard, the detector is arranged with a sensing arm 54 that moves in conjunction with the bottom roller 34, as the roller is cammed toward or away from its cooperating position with the pull-foot 23. The end 56 of the sensing arm 54 represents an amplified position of the roller 34. If this arm 54 moves too far upward (a "miss") a sensor 58 is grounded through a fixed miss contact 60. Similarly, if the arm does not move far enough upward (a "double"), it is grounded through a double contact 62. A light chopper 64 is set to rotate in timed relationship to the positional movement of the roller 34, so that it gates the signal of the sensor 58 only when the bottom roller 34 is first moved to an upward position where it should be engaging a sheet with the pull-foot.

While the invention has been particularly shown and described with reference to preferred embodiments thereof, it will be understood by those skilled in the art that various alterations in form and detail may be made therein without departing from the spirit and scope of the invention. For example, the sucker or separator foot may assume various alterations in form without affecting its designated performance.

The embodiments of the invention in which an exclusive property or privilege is claimed are defined as follows:

1. A sheet finding mechanism for feeding individual sheets separately from a stack comprising:

a main hopper assembly for supporting a stack of sheets;

means for drawing an exposed edge of an outer sheet away from the remaining stack;

a pull-foot reciprocally movable between a first position in which it is between the remaining stack and the edge of the outer sheet which has been exposed and a second position in which it is away from the hopper assembly;

roller means arranged to cooperate with the pull-foot, for continuously pinching the outer sheet between it and the pull foot while rolling on the sheet as the pull-foot moves away from the remaining stack and pulls the outer sheet from the remaining stack; and a further means for relatively moving said roller means and said pull-foot laterally toward each other in timed relation with reciprocations of said pull-foot for pinching the outer sheet between them.

2. The sheet feeding mechanism of claim 1 wherein the means for drawing the exposed edge of an outer sheet away from the remaining stack is a sucker foot.

3. The sheet feeding mechanism of claim 2 wherein the sucker foot is mounted for reciprocating motion toward and away from the exposed edge of the stack of sheets.

4. The sheet feeding mechanism of claim 1 including a separator foot which can be moved into supporting position between an outer sheet and the remaining stack, after the exposed edge has been drawn away from the stack.

5. The sheet feeding mechanism of claim 1 wherein a bottom-plate support of the hopper assembly is equipped with adjustable supporting surfaces, so that sheets of various sizes can be accommodated.

6. The sheet feeding mechanism of claim wherein the pull-foot is equipped with a high-friction sole to increase sheet pinching cooperation with the roller means.

7. The sheet feeding mechanism of claim 1 wherein the pull-foot is positively driven between its first and second positions by a driving means other than said roller means.

8. The sheet feeding mechanism of claim 1 wherein is further included a means for rotating said roller means and said pull-foot is positively driven from its first position to its second position by rotation of said roller means.

9. The sheet feeding mechanism of claim 1 wherein said roller means includes a sensor for monitoring the position of said roller means when said roller means pinches said outer sheet, to sense a miss or a double.

10. A method of feeding individual sheets from a held stack of sheets comprising the steps of:

supporting a stack of sheets in a hopper assembly;

drawing an exposed edge of an outer sheet away from the remaining stack;

reciprocating a pull-foot into position between the remaining stack and the drawn exposed edge of the outer sheet;

relatively moving a roller means toward the pull-foot to cooperate with the pull-foot so that the exposed edge of the outer sheet is pinched between the pull-foot and roller means; and reciprocally driving the pull-foot away from the stack while maintaining the outer sheet pinched between the pull-foot and roller means.

11. The method of feeding sheets of claim 10 wherein is further included a means for rotating said roller means and the pull-foot is driven away from the stack by rotation of the roller means.

12. The method of feeding sheets of claim 10 wherein the pull-foot is driven away from the stack by a means other than the roller means and said roller means is an idler roller.

13. The method of feeding sheets of claim 10 wherein is included the further step of sensing the position of said roller means when it is positioned to pinch an outer sheet between it and the pull-foot, to determine if a miss or a double has occurred.

14. A sheet feeding mechanism as in claim 1 wherein said roller means is an idler roller.

15. A sheet feeding mechanism as in claim 14 wherein said relative lateral movement between said idler roller and said pull-foot is produced by said further means moving said idler roller laterally to its axis.

16. A sheet feeding mechanism as in claim 1 wherein said relative lateral movement between said roller means and said pull-foot is produced by said further means moving said roller means laterally to its axis.

* * * * *

UNITED STATES PATENT AND TRADEMARK OFFICE

CERTIFICATE OF CORRECTION

PATENT NO. : 4,013,283
DATED : March 22, 1977
INVENTOR(S) : Norwood E. Tress, Winston A. Orsinger It is certified that error appears in the above-identified patent and that said Letters Patent are hereby corrected as shown below:

Claim 1, line 1, change "finding" to --feeding--.
Claim 6, line 1, after the word "claim" insert --1--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*